US007781665B2

(12) United States Patent
Szczerba et al.

(10) Patent No.: US 7,781,665 B2
(45) Date of Patent: Aug. 24, 2010

(54) SOUND SYNTHESIS

(75) Inventors: Marek Zbigniew Szczerba, Eindhoven (NL); Albertus Cornelis den Brinker, Eindhoven (NL); Andreas Johannes Gerrits, Oeffelt (NL); Arnoldus Werner Johannes Oomen, Eindhoven (NL); Marc Klein Middelink, Huissen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 86 days.

(21) Appl. No.: 11/908,321

(22) PCT Filed: Feb. 1, 2006

(86) PCT No.: PCT/IB2006/050338

§ 371 (c)(1),
(2), (4) Date: Sep. 11, 2007

(87) PCT Pub. No.: WO2006/085244

PCT Pub. Date: Aug. 17, 2006

(65) Prior Publication Data

US 2008/0184871 A1 Aug. 7, 2008

(30) Foreign Application Priority Data

Feb. 10, 2005 (EP) ..... 05100948

(51) Int. Cl.
*G10H 7/00* (2006.01)

(52) U.S. Cl. ..... 84/622; 84/659; 84/632; 84/662

(58) Field of Classification Search ..... 84/600–602, 84/622, 659, 632, 662; 700/94
See application file for complete search history.

(56) References Cited

U.S. PATENT DOCUMENTS

| | | | | | |
|---|---|---|---|---|---|
| 4,942,799 | A | * | 7/1990 | Suzuki | 84/603 |
| 5,029,509 | A | * | 7/1991 | Serra et al. | 84/625 |
| 5,220,629 | A | * | 6/1993 | Kosaka et al. | 704/260 |
| 5,248,845 | A | * | 9/1993 | Massie et al. | 84/622 |
| 5,401,897 | A | * | 3/1995 | Depalle et al. | 84/625 |
| 5,686,683 | A | * | 11/1997 | Freed | 84/625 |

(Continued)

FOREIGN PATENT DOCUMENTS

WO 200011649 3/2000

OTHER PUBLICATIONS

M. Szcserba et al., "Parametric Audio Coding Based Wavetable Synthesis", Audio Engineering Society Convention Paper No. 6063, Berlin, Germany, May 2004.

(Continued)

*Primary Examiner*—David S. Warren

(57) ABSTRACT

A device (1) is arranged for synthesizing sound represented by sets of parameters, each set comprising noise parameters (NP) representing noise components of the sound and optionally also other parameters representing other components, such as transients and sinusoids. Each set of parameters may correspond with a sound channel, such as a MIDI voice. In order to reduce the computational load, the device comprises a selection unit (2) for selecting a limited number of sets from the total number of sets on the basis of a perceptual relevance value, such as the amplitude or energy. The device further comprises a synthesizing unit (3) for synthesizing the noise components using the noise parameters of the selected sets only.

25 Claims, 4 Drawing Sheets

U.S. PATENT DOCUMENTS

Figure 1:
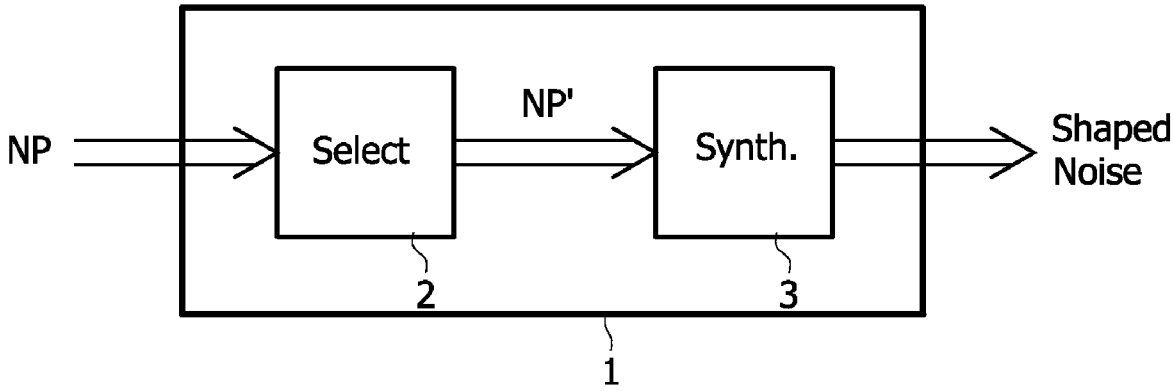

| | | | | | |
|---|---|---|---|---|---|
| 5,698,807 | A | * | 12/1997 | Massie et al. | 84/661 |
| 5,744,742 | A | | 4/1998 | Lindemann | |
| 5,763,800 | A | * | 6/1998 | Rossum et al. | 84/603 |
| 5,880,392 | A | * | 3/1999 | Wessel et al. | 84/659 |
| 5,886,276 | A | | 3/1999 | Levine | |
| 5,900,568 | A | * | 5/1999 | Abrams | 84/622 |
| 5,920,843 | A | * | 7/1999 | Fay | 704/503 |
| 5,977,469 | A | | 11/1999 | Smith | |
| 6,240,386 | B1 | | 5/2001 | Thyssen et al. | |
| 6,675,144 | B1 | | 1/2004 | Tucker et al. | |
| 6,919,502 | B1 | * | 7/2005 | Yamamoto | 84/622 |
| 7,259,315 | B2 | * | 8/2007 | Tamura et al. | 84/627 |
| 7,319,756 | B2 | * | 1/2008 | Oomen et al. | 380/236 |
| 2001/0027392 | A1 | | 10/2001 | Wiese, Jr. | |
| 2002/0053274 | A1 | * | 5/2002 | Yahata | 84/634 |
| 2002/0154774 | A1 | * | 10/2002 | Oomen et al. | 380/236 |
| 2002/0156619 | A1 | * | 10/2002 | Van De Kerkhof et al. | 704/203 |
| 2005/0004791 | A1 | | 1/2005 | Van De Kerkhof | |
| 2005/0021328 | A1 | * | 1/2005 | Van De Kerkhof et al. | 704/216 |
| 2006/0149532 | A1 | * | 7/2006 | Boillot et al. | 704/203 |
| 2007/0124136 | A1 | * | 5/2007 | Den Brinker et al. | 704/205 |
| 2008/0052783 | A1 | * | 2/2008 | Levy | 726/26 |
| 2009/0308229 | A1 | * | 12/2009 | Szczerba et al. | 84/622 |

OTHER PUBLICATIONS

S.N. Levine, "Audio Representations for Data Compression and Compressed Domain Processing", Stanford University, USA, 1999, Chapter 5.

* cited by examiner

SOUND SYNTHESIS

The present invention relates to the synthesis of sound. More in particular, the present invention relates to a device and a method for synthesizing sound represented by sets of parameters, each set comprising noise parameters representing noise components of the sound and other parameters representing other components.

It is well known to represent sound by sets of parameters. So-called parametric coding techniques are used to efficiently encode sound, representing the sound by a series of parameters. A suitable decoder is capable of substantially reconstructing the original sound using the series of parameters. The series of parameters may be divided into sets, each set corresponding with an individual sound source (sound channel) such as a (human) speaker or a musical instrument.

The popular MIDI (Musical Instrument Digital Interface) protocol allows music to be represented by sets of instructions for musical instruments. Each instruction is assigned to a specific instrument. Each instrument can use one or more sound channels (called "voices" in MIDI). The number of sound channels that may be used simultaneously is called the polyphony level or the polyphony. The MIDI instructions can be efficiently transmitted and/or stored.

Synthesizers typically contain sound definition data, for example a sound bank or patch data. In a sound bank samples of the sound of instruments are stored as sound data, while patch data define control parameters for sound generators.

MIDI instructions cause the synthesizer to retrieve sound data from the sound bank and synthesize the sounds represented by the data. These sound data may be actual sound samples, that is digitized sounds (waveforms), as in the case of conventional wavetable synthesis. However, sound samples typically require large amounts of memory, which is not feasible in relatively small devices, in particular hand-held consumer devices such as mobile (cellular) telephones.

Alternatively, the sound samples may be represented by parameters, which may include amplitude, frequency, phase, and/or envelope shape parameters and which allow the sound samples to be reconstructed. Storing the parameters of sound samples typically requires far less memory than storing the actual sound samples. However, the synthesis of the sound may be computationally burdensome. This is particularly the case when many sets of parameters, representing different sound channels ("voices" in MIDI), have to be synthesized simultaneously (high degree of polyphony). The computational burden typically increases linearly with the number of channels ("voices") to be synthesized, that is, with the degree of polyphony. This makes it difficult to use such techniques in hand-held devices.

The paper "Parametric Audio Coding Based Wavetable Synthesis" by M. Szczerba, W. Oomen and M. Klein Middelink, Audio Engineering Society Convention Paper No. 6063, Berlin (Germany), May 2004, discloses an SSC (Sinus-Soidal Coding) wave-table synthesizer. An SSC encoder decomposes the audio input into transients, sinusoids and noise components and generates a parametric representation for each of these components. These parametric representations are stored in a sound bank. The SSC decoder (synthesizer) uses this parametric representation to reconstruct the original audio input. To reconstruct the noise components, the temporal envelopes of the individual sound channels are combined with the respective gains and added, after which white noise is mixed with this combined temporal envelope to produce a temporally shaped noise signal. Spectral envelope parameters of the individual channels are used to produce filter coefficients for filtering the temporally shaped noise signal so as to produce a noise signal that is both temporally and spectrally shaped.

Although this known arrangement is very effective, determining both the temporal envelope and the spectral envelope for many sound channels involves a substantial computational load. In many modern sound systems, 64 sound channels can be used and larger numbers of sound channels are envisaged. This makes the known arrangement unsuitable for use in relatively small devices having limited computing power.

On the other hand there is an increasing demand for sound synthesis in hand-held consumer devices, such as mobile telephones. Consumers nowadays expect their hand-held devices to produce a wide range of sounds, such as different ring tones.

It is therefore an object of the present invention to overcome these and other problems of the Prior Art and to provide a device and a method for synthesizing the noise components of sound, which device and method are more efficient and reduce the computational load.

Accordingly, the present invention provides a device for synthesizing sound represented by sets of parameters, each set comprising noise parameters representing noise components of the sound, the device comprising:

selecting means for selecting a limited number of sets from the total number of sets on the basis of a perceptual relevance value, and synthesizing means for synthesizing the noise components using the noise parameters of the selected sets only.

By selecting a limited number of parameter sets and using only this limited number of parameters sets for the synthesis, effectively disregarding the remaining sets, the computational load of the synthesis can be significantly reduced. By selecting the sets using a perceptual relevance value, the perceptual effect of not using some sets of parameters is surprisingly small.

It would be expected that using, for example, only five out of 64 sets of parameters would seriously affect the perceived quality of the reconstructed (that is, synthesized) sound. However, the inventors have found that by properly selecting five sets as in the present example, the sound quality is not affected. When the number of sets is further reduced, a degradation of the sound quality results. However, this degradation is gradual and a number of three selected sets may still be acceptable.

The sets of parameters may, in addition to noise parameters representing noise components of the sound, also comprise other parameters representing other components of the sound. Accordingly, each set of parameters may comprise noise parameters and other parameters, such as sinusoidal and/or transient parameters. However, it is also possible for the sets to contain noise parameters only.

It is noted that the selection of sets of noise parameters is preferably independent of any other parameters, such as sinusoids and transients parameters. However, in some embodiments the selecting means are also arranged for selecting a limited number of sets from the total number of sets on the basis of one or more other parameters representing other sound components. That is, any sinusoidal and/or transient component parameters of a set may be involved in, and thereby influence, the selection of noise parameters of the set.

In a preferred embodiment, the device comprises a decision section for deciding which parameter sets to select, and a selection section for selecting parameter sets on the basis of information provided by the decision section. However, embodiments can be envisaged in which the decision section and selection section constitute a single, integral unit. Alternatively, the device may comprise a selection section for selecting parameter sets on the basis of perceptual relevance values contained in the sets of parameters. If the perceptual relevance values, or any other values which may determine the selection without any further decision process, are contained in the sets of parameters, the decision section is no longer required.

The synthesizing device of the present invention may comprise a single filter for spectrally shaping the noise of all selected sets, and a Levinson-Durbin unit for determining filter parameters of the filter, wherein the single filter preferably is constituted by a Laguerre filter. In this way, a very efficient synthesis is achieved.

Advantageously, the device of the present invention may further comprise gain compensation means for compensating the gains of the selected noise components for any energy loss due to any rejected noise components. The gain compensation means allow the total energy of the noise to remain substantially unaffected by the selection process as the energy of any rejected noise components is distributed over the selected noise components.

In addition, the present invention provides an encoding device for representing sound by sets of parameters, each set of parameters comprising noise parameters representing noise components of the sound, the device comprising a relevance detector for providing relevance values representing the perceptual relevance of the respective noise parameters. The relevance parameters are preferably added to the respective sets and may be determined on the basis of perceptual models. The resulting sets of parameters may be reconverted into sound by a synthesizing device as defined above.

The present invention also provides a consumer device comprising a synthesizing device as defined above. The consumer device is preferably but not necessarily portable, still more preferably hand-held, and may be constituted by a mobile (cellular) telephone, a CD player, a DVD player, an MP3 player, a PDA (Personal Digital Assistant) or any other suitable apparatus.

The present invention further provides a method of synthesizing sound represented by sets of parameters, each set comprising noise parameters representing noise components of the sound, the method comprising the steps of:

selecting a limited number of sets from the total number of sets on the basis of a perceptual relevance value, and synthesizing the noise components using the noise parameters of the selected sets only.

In the method of the present invention, the perceptual relevance value may be indicative of the amplitude of the noise and/or of the energy of the noise.

The sets of parameters may contain only noise parameters, but may also contain other parameters representing other components of the sound, such as sinusoids and/or transients.

The method of the present invention may comprise the further step of compensating the gains of the selected noise components for any energy loss due to any rejected noise components. By applying this step, the total energy of the noise is substantially unaffected by the selection process.

The present invention additionally provides a computer program product for carrying out the method defined above. A computer program product may comprise a set of computer executable instructions stored on an optical or magnetic carrier, such as a CD or DVD, or stored on and downloadable from a remote server, for example via the Internet.

The present invention will further be explained below with reference to exemplary embodiments illustrated in the accompanying drawings, in which:

FIG. 1 schematically shows a noise synthesis device according to the present invention.

Figure 2:
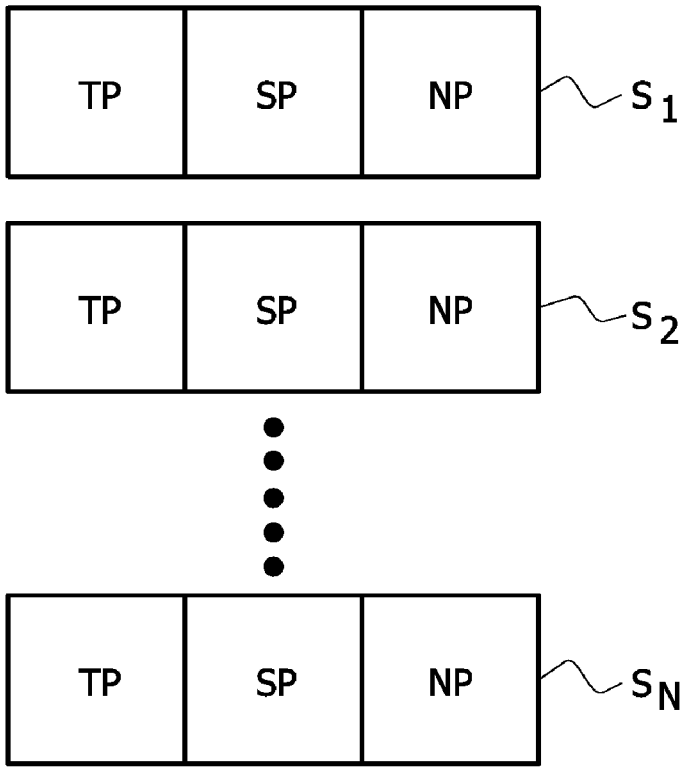

FIG. 2 schematically shows sets of parameters representing sound as used in the present invention.

Figure 3:
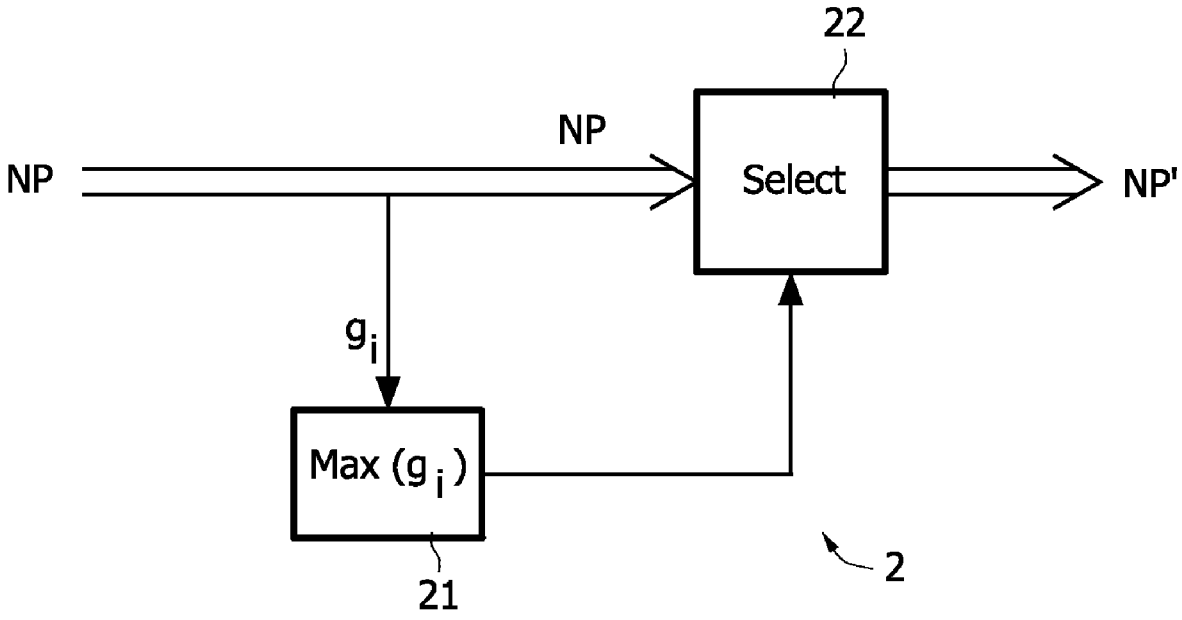

FIG. 3 schematically shows the selection part of the device of FIG. 1 in more detail.

Figure 4:
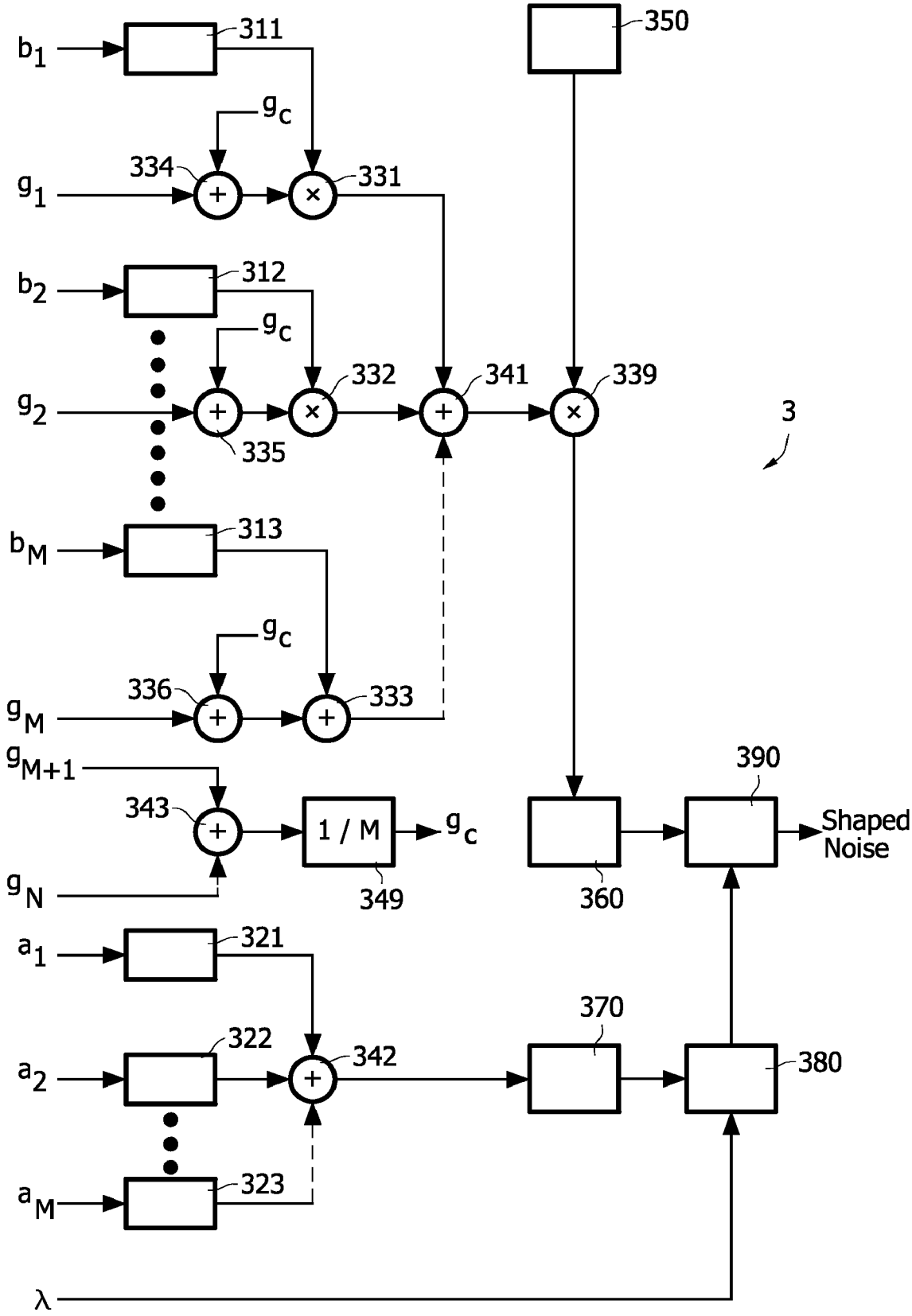

FIG. 4 schematically shows the synthesis part of the device of FIG. 1 in more detail.

Figure 5:
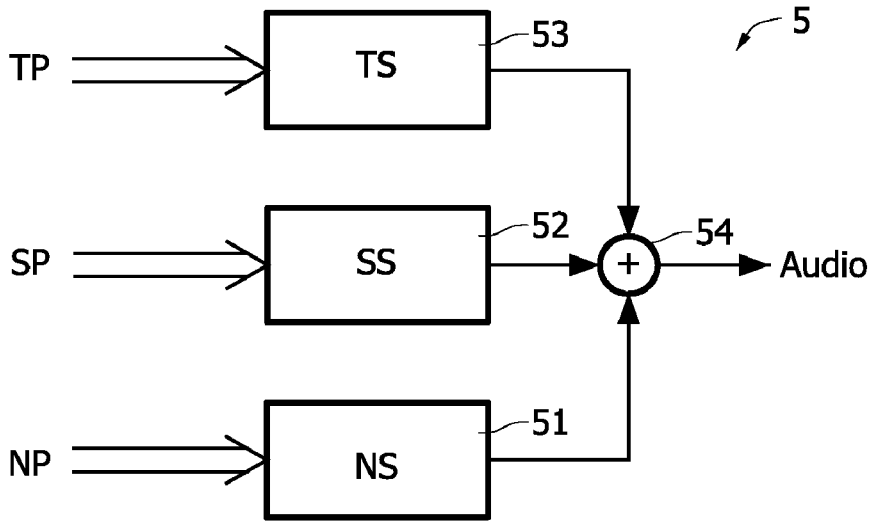

FIG. 5 schematically shows a sound synthesis device which incorporates the device of the present invention.

Figure 6:
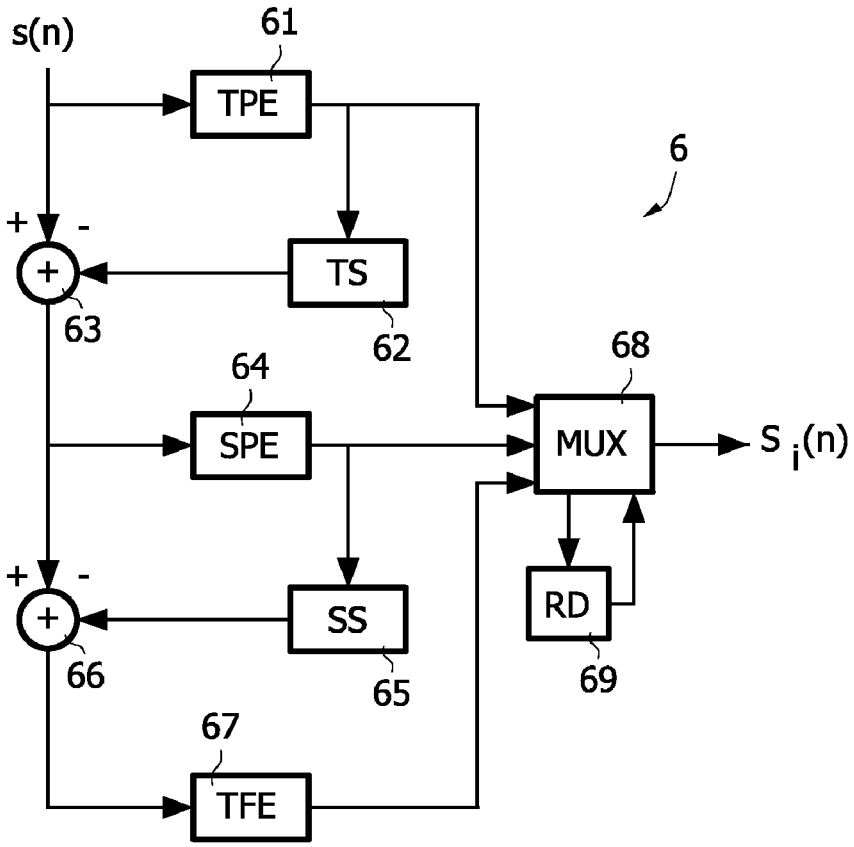

FIG. 6 schematically shows an audio encoding device.

The noise synthesis device 1 shown merely by way of non-limiting example in FIG. 1 comprises a selection unit (selection means) 2 and a synthesis unit (synthesis means) 3. In accordance with the present invention, the selection unit 2 receives noise parameters NP, selects a limited number of noise parameters and passes these selected parameters NP' on to the synthesis unit 3. The synthesis unit 3 uses only the selected noise parameters NP' to synthesize shaped noise, that is, noise of which the temporal and/or spectral envelope has been shaped. An exemplary embodiment of the synthesis unit 3 will later be discussed in more detail with reference to FIG. 4.

The noise parameters NP may be part of sets $S_1, S_2, \ldots, S_N$ of sound parameters, as illustrated in FIG. 2. The sets $S_i$ (i=1 . . . N) comprise, in the illustrated example, transient parameters TP representing transient sound components, sinusoidal parameters SP representing sinusoidal sound components, and noise parameters NP representing noise sound components. The sets $S_i$ may have been produced using an SSC encoder as mentioned above, or any other suitable encoder. It will be understood that some encoders may not produce transients parameters (TP) while others may not produce sinusoidal parameters (SP). The parameters may or may not comply with MIDI formats.

Each set $S_i$ may represent a single active sound channel (or "voice" in MIDI systems).

The selection of noise parameters is illustrated in more detail in FIG. 3, which schematically shows an embodiment of the selection unit 2 of the device 1. The exemplary selection unit 2 of FIG. 3 comprises a decision section 21 and a selection section 22. Both the decision section 21 and the selection section 22 receive the noise parameters NP. The decision section 21 only requires suitable constituent parameters on which a selection decision is to be based.

A suitable constituent parameter is a gain $g_i$. In the preferred embodiment, $g_i$ is the gain of the temporal envelope of the noise of set $S_i$ (see FIG. 2). However, the amplitudes of the individual noise components can also be used, or an energy value may be derived from the parameters. It will be clear that the amplitude and the energy are indicative of the perception of the noise and that their magnitudes therefore constitute perceptual relevance values. Advantageously, a perceptual model (for example involving the acoustic and psychological perception of the human ear) is used to determine and (optionally) weigh suitable parameters.

The decision section 21 decides which noise parameters are to be used for the noise synthesis. The decision is made using an optimization criterion which is applied on the perceptual relevance values, for example finding the five highest gains out of the available gains $g_i$. The corresponding set numbers (for example 2, 3, 12, 23 and 41) are fed to the selection section 22. In some embodiments, selection parameters (that is, relevance values) may already be included in the noise parameters NP. In such embodiments, the decision section 21 may be omitted.

The selection section 22 is arranged for selecting the noise parameters of the sets indicated by the decision section 21. The noise parameters of the remaining sets are disregarded. As a result, only a limited number of noise parameters is passed on to the synthesizing unit (3 in FIG. 1) and subsequently synthesized. Accordingly, the computational load of the synthesizing unit is significantly reduced.

The inventors have gained the insight that the number of noise parameters used for synthesis can be drastically reduced without any substantial loss of sound quality. The number of selected sets can be relatively small, for example 5 out of a total of 64 (7.8%). In general, the number of selected sets should be at least approximately 4.5% of the total number to prevent any perceptible loss of sound quality, although at least 10% is preferred. If the number of selected sets is further reduced below approximately 4.5%, the quality of the synthesized sound gradually decreases but may, for some applications, still be acceptable. It will be understood that higher percentages, such as 15%, 20%, 30% or 40% may also be used, although this will increase the computational load.

The decision which sets to include and which not, made by the decision section 21, is made on the basis of a perceptual relevance value, for example the amplitude (level) of the noise components, articulation data from the sound bank (controlling the envelope generator, low frequency oscillator, etc.) and information from MIDI data, for example note-on velocity and articulation related controllers. Other perceptual relevance values may also be utilized. Typically, a number of M sets having the largest perceptual values are selected, for example the highest noise amplitudes (or gains).

Additionally, or alternatively, other parameters from each set may be used by the decision section 21. For example, sinusoidal parameters can be used to reduce the number of noise parameters. Using sinusoidal (and/or transient) parameters, a masking curve can be constructed such that noise parameters having an amplitude lower than the masking curve can be omitted. The noise parameters of a set may thus be compared with the masking curve. If they fall below the curve, the noise parameters of the set may be rejected.

It will be understood that the sets $S_i$ (FIG. 2) and the noise selection and synthesis is typically carried out per time unit, for example per time frame. The noise parameters, and other parameters, may therefore refer to a certain time unit only. Time units, such as time frames, may partially overlap.

An exemplary embodiment of the synthesis unit 3 of FIG. 1 is shown in more detail in FIG. 4. In this embodiment, the noise is produced using both a temporal (time domain) envelope and a spectral (frequency domain) envelope.

Temporal envelope generators 311, 312 and 313 receive envelope parameters $b_i$ (i=1 . . . M) corresponding with the selected sets $S_i$ respectively. In accordance with the present invention, the number M of selected sets is smaller than the number N of available sets. The temporal envelope parameters $b_i$ define temporal envelopes which are output by the generators 311-313. Multipliers 331, 332 and 333 multiply the temporal envelopes by respective gains $g_i$. The resulting gain adjusted temporal envelopes are added by an adder 341 and fed to a further multiplier 339, where they are multiplied with (white) noise generated by noise generator 350. The resulting noise signal, which has been temporally shaped but typically has a virtually uniform spectrum, is fed to an (optional) overlap-and-add circuit 360. In this circuit, the noise segments of subsequent time frames are combined to form a continuous signal which is fed to the filter 390.

As mentioned above, the gains $g_1$ to $g_M$ correspond with the selected sets. As there are N available sets, the gains $g_{M+1}$ to $g_N$ correspond with the rejected sets. In the preferred embodiment illustrated in FIG. 4, the gains $g_{M+1}$ to $g_N$ are not discarded but are used to adjust the gains $g_1$ to $g_M$. This gain compensation serves to reduce or even eliminate the effect of the selection of noise parameters on the level (that is, amplitude) of the synthesized noise.

Accordingly, the embodiment of FIG. 4 additionally comprises an adder 343 and a scaling unit 349. The adder 343 adds the gains $g_{M+1}$ to $g_N$ and feeds the resulting cumulative gain to the scaling unit 349 where a scaling factor 1/M is applied, M being the number of selected sets as before, to produce a compensation gain $g_C$. This compensation gain $g_C$ is then added to each of the gains $g_1$ to $g_M$ by adders 334, 335, . . . , the number of adders being equal to M. By distributing the cumulative gain of the rejected components over the selected components, the energy of the noise remains substantially constant and sound level changes due to the selection of noise components are avoided.

It will be understood that the adder 343, the scaling unit 349 and the adders 334, 335, . . . are optional and that in other embodiments these units may not be present. The scaling unit 349, if present, may alternatively be arranged between the adder 341 and the multiplier 339.

The filter 390, which in the preferred embodiment is a Laguerre filter, serves to spectrally shape the noise signal. Spectral envelope parameters $a_i$, which are derived from the selected sets $S_i$, are fed to autocorrelation units 321 which calculate the autocorrelation of these parameters. The resulting autocorrelations are added by an adder 342 and fed to a unit 370 to determine the filter coefficients of the spectral shaping filter 390. In the preferred embodiment, the unit 370 is arranged for determining filter coefficients in accordance with the well-known Levinson-Durbin algorithm. The resulting linear filter coefficients are then converted into Laguerre filter coefficients by a conversion unit 380. The Laguerre filter 390 is then used to shape the spectral envelope of the (white) noise.

Instead of determining an autocorrelation function of each group of parameters $a_i$, a more efficient method is used. The power spectra of the selected sets (that is, of the selected active channels or "voices") are calculated and then an autocorrelation function is computed by inversely Fourier transforming the summed power spectra. The resulting auto-correlation function is then fed to the Levinson-Durbin unit 370.

It will be understood that the parameters $a_i$, $b_i$, $g_i$ and $\lambda$ are all part of the noise parameters denoted NP in FIGS. 1 and 2. In the selection unit embodiment of FIG. 3, the decision section 22 uses the gain parameters $g_i$ only. However, embodiments can be envisaged in which some or all of the parameters $a_i$, $b_i$, $g_i$ and $\lambda$, and possibly other parameters (for example relating to sinusoidal components and/or transients) are used by the decision section 22. It is noted that the parameter $\lambda$ may be a constant and need not be part of the noise parameters NP.

A sound synthesizer in which the present invention may be utilized is schematically illustrated in FIG. 5. The synthesizer 5 comprises a noise synthesizer 51, a sinusoids synthesizer 52 and a transients synthesizer 53. The output signals (synthesized transients, sinusoids and noise) are added by an adder 54 to form the synthesized audio output signal. The noise synthesizer 51 advantageously comprises a device (1 in FIG. 1) as defined above.

The synthesizer 5 may be part of an audio (sound) decoder (not shown). The audio decoder may comprise a demultiplexer for demultiplexing an input bit stream and separating out the sets of transients parameters (TP), sinusoidal parameters (SP), and noise parameters (NP).

The audio encoding device 6 shown merely by way of non-limiting example in FIG. 6 encodes an audio signal s(n) in three stages.

In the first stage, any transient signal components in the audio signal s(n) are encoded using the transients parameter extraction (TPE) unit 61. The parameters are supplied to both a multiplexing (MUX) unit 68 and a transients synthesis (TS) unit 62. While the multiplexing unit 68 suitably combines and multiplexes the parameters for transmission to a decoder, such as the device 5 of FIG. 5, the transients synthesis unit 62 reconstructs the encoded transients. These reconstructed transients are subtracted from the original audio signal s(n) at the first combination unit 63 to form an intermediate signal from which the transients are substantially removed.

In the second stage, any sinusoidal signal components (that is, sines and cosines) in the intermediate signal are encoded by the sinusoids parameter extraction (SPE) unit 64. The resulting parameters are fed to the multiplexing unit 68 and to a sinusoids synthesis (SS) unit 65. The sinusoids reconstructed by the sinusoids synthesis unit 65 are subtracted from the intermediate signal at the second combination unit 66 to yield a residual signal.

In the third stage, the residual signal is encoded using a time/frequency envelope data extraction (TFE) unit 67. It is noted that the residual signal is assumed to be a noise signal, as transients and sinusoids are removed in the first and second stage. Accordingly, the time/frequency envelope data extraction (TFE) unit 67 represents the residual noise by suitable noise parameters.

An overview of noise modeling and encoding techniques according to the Prior Art is presented in Chapter 5 of the dissertation "Audio Representations for Data Compression and Compressed Domain Processing", by S. N. Levine, Stanford University, USA, 1999, the entire contents of which are herewith incorporated in this document.

The parameters resulting from all three stages are suitably combined and multiplexed by the multiplexing (MUX) unit 68, which may also carry out additional coding of the parameters, for example Huffman coding or time-differential coding, to reduce the bandwidth required for transmission.

It is noted that the parameter extraction (that is, encoding) units 61, 64 and 67 may carry out a quantization of the extracted parameters. Alternatively or additionally, a quantization may be carried out in the multiplexing (MUX) unit 68. It is further noted that s(n) is a digital signal, n representing the sample number, and that the sets $S_i(n)$ are transmitted as digital signals. However, may also be applied to analog signals.

After having been combined and multiplexed (and optionally encoded and/or quantized) in the MUX unit 68, the parameters are transmitted via a transmission medium, such as a satellite link, a glass fiber cable, a copper cable, and/or any other suitable medium.

The audio encoding device 6 further comprises a relevance detector (RD) 69. The relevance detector 69 receives predetermined parameters, such as noise gains $g_i$ (as illustrated in FIG. 3), and determines their acoustic (perceptual) relevance. The resulting relevance values are fed back to the multiplexer 68 where they are inserted into the sets $S_i(n)$ forming the output bit stream. The relevance values contained in the sets may then be used by the decoder to select appropriate noise parameters without having to determine their perceptual relevance. As a result, the decoder can be simpler and faster.

Although the relevance detector (RD) 69 is shown in FIG. 6 to be connected to the multiplexer 68, the relevance detector 69 may instead be directly connected to the time/frequency envelope data extraction (TFE) unit 67. The operation of the relevance detector 69 may be similar to the operation of the decision section 21 illustrated in FIG. 3.

The audio encoding device 6 of FIG. 6 is shown to have three stages. However, the audio encoding device 6 may also consist of less than three stages, for example two stages producing sinusoidal and noise parameters only, or more are than three stages, producing additional parameters. Embodiments can therefore be envisaged in which the units 61, 62 and 63 are not present. The audio encoding device 6 of FIG. 6 may advantageously be arranged for producing audio parameters that can be decoded (synthesized) by a synthesizing device as shown in FIG. 1.

The synthesizing device of the present invention may be utilized in portable devices, in particular hand-held consumer devices such as cellular telephones, PDAs (Personal Digital Assistants), watches, gaming devices, solid-state audio players, electronic musical instruments, digital telephone answering machines, portable CD and/or DVD players, etc.

From the above it will be clear that the present invention also provides a method of synthesizing sound represented by sets of parameters, wherein each set of parameters comprises both noise parameters representing noise components of the sound and optionally also other parameters representing other components, such as transients and/or sinusoids. The method of the present invention essentially comprises the steps of:

selecting a limited number of sets from the total number of sets on the basis of a perceptual relevance value, and synthesizing the noise components using the noise parameters of the selected sets only.

The method of the present invention may additionally comprise the optional step of compensating the gains of the selected noise components for any energy loss caused by rejecting noise components. Further optional method steps can be derived from the description above.

Additionally, the present invention provides an encoding device for representing sound by sets of parameters, each set of parameters comprising noise parameters representing noise components of the sound and preferably also transients and/or sinusoids parameters, the device comprising a relevance detector for providing relevance values representing the perceptual relevance of the respective noise parameters.

The present invention is based upon the insight that selecting a limited number of sound channels when synthesizing noise components of sound may result in virtually no degradation of the synthesized sound. The present invention benefits from the further insight that selecting the sound channels on the basis of a perceptual relevance value minimizes or eliminates any distortion of the synthesized sound.

It is noted that any terms used in this document should not be construed so as to limit the scope of the present invention. In particular, the words "comprise(s)" and "comprising" are not meant to exclude any elements not specifically stated. Single (circuit) elements may be substituted with multiple (circuit) elements or with their equivalents.

It will be understood by those skilled in the art that the present invention is not limited to the embodiments illustrated above and that many modifications and additions may be made without departing from the scope of the invention as defined in the appending claims.

The invention claimed is:

1. A device for synthesizing sound represented by sets of parameters, each set comprising noise parameters representing noise components of the sound, the device comprising:

selecting means for selecting a plurality of sets from the total number of sets on the basis of each of the selected plurality of sets having at least one of a higher gain, amplitude and energy of noise components than sets not selected, wherein the selected plurality of sets is less than the total number of sets, and synthesizing means for synthesizing the noise components using the noise parameters of the selected plurality of sets only, out of the total number of sets that are available to the device.

2. The device according to claim 1, wherein the selected plurality of sets is five sets selected on the basis of having a higher gain than sets not selected.

3. The device according to claim 1, wherein a set of parameters further comprises other parameters representing at least one of transient components and sinusoidal components of the sound.

4. The device according to claim 3, wherein the selecting means are also arranged for selecting a limited number of sets from the total number of sets on the basis of one or more of the other parameters representing other components of the sound.

5. The device according to claim 1, wherein the noise parameters define at least one of a temporal envelope and a spectral envelope of the noise.

6. The device according to claim 1, wherein each set of parameters corresponds with a sound channel.

7. The device according to claim 1, comprising a decision section for deciding which parameter sets to select, and a selection section for selecting parameter sets on the basis of information provided by the decision section.

8. The device according to claim 1, comprising a selection section for selecting parameter sets on the basis of having a higher amplitude of noise components than sets not selected.

9. The device according to claim 1, wherein the synthesizing means comprise a single filter for spectrally shaping the noise of all selected sets and a Levinson-Durbin unit for determining filter parameters of the filter, and wherein the single filter preferably is constituted by a Laguerre filter.

10. The device according to claim 1, further comprising gain compensation means for compensating the gains of the selected noise components for any energy loss due to any rejected noise components by accumulating gains of each of the sets not selected and distributing the accumulated gains over the selected plurality of sets.

11. The device according to claim 1, wherein the device is a MIDI synthesizer.

12. The device according to claim 1, wherein the device is a cellular telephone.

13. A method of synthesizing sound represented by sets of parameters, each set comprising noise parameters representing noise components of the sound, the method comprising acts of:

selecting a plurality of sets from the total number of sets on the basis of each set of the plurality of sets having at least one of a higher gain, amplitude and energy of noise components than sets not selected, wherein the plurality of sets is less than the total number of sets, and synthesizing the noise components using the noise parameters of the plurality of sets only, out of the total number of sets that are available to by synthesized.

14. The method according to claim 13, wherein the plurality of sets is five sets selected on the basis of having a higher gain than sets not selected.

15. The method according to claim 13, wherein a set of parameters further comprises other parameters representing at least one of transient components and sinusoidal components of the sound.

16. The method according to claim 15, wherein the act of selecting a limited number of sets from the total number of sets is also carried out on the basis of one or more of the other parameters representing other components of the sound.

17. The method according to claim 13, wherein the noise parameters define at least one of a temporal envelope and a spectral envelope of the noise.

18. The method according to claim 13, wherein each set of parameters corresponds with a sound channel.

19. The method according to claim 13, further comprising an act of compensating the gains of the selected noise components for any energy loss due to any rejected noise components by accumulating gains of each of the sets not selected and distributing the accumulated gains over the selected plurality of sets.

20. The method according to claim 13, wherein each set of parameters corresponds with a MIDI voice sound channel.

21. The method according to claim 13, wherein each set of parameters contains perceptual relevance values.

22. A computer program stored on a computer readable memory medium that when executed by a computer programs the computer for synthesizing sound represented by sets of parameters, each set comprising noise parameters representing noise components of the sound, the computer being programmed to execute acts of:

selecting a plurality of sets from the total number of sets on the basis of a perceptual relevance value each of the selected plurality of sets having at least one of a higher gain, amplitude and energy of noise components than sets not selected, wherein the selected plurality of sets is less than the total number of sets, and synthesizing the noise components using the noise parameters of the selected plurality of sets only, out of the total number of sets that are available to by synthesized.

23. The device according to claim 1, wherein the selecting means selects the plurality of sets on the basis of each of the selected plurality of sets having an amplitude and an energy indicative of the perception of the noise components of the sound that is higher than sets not selected.

24. The method according to claim 13, wherein the act of selecting comprises an act of selecting the plurality of sets on the basis of each of the selected plurality of sets having an amplitude and an energy indicative of the perception of the noise components of the sound that is higher than sets not selected.

25. The computer program according to claim 22, wherein the act of selecting comprises an act of selecting the plurality of sets on the basis of each of the selected plurality of sets having an amplitude and an energy indicative of the perception of the noise components of the sound that is higher than sets not selected.

* * * * *